United States Patent [19]

Star et al.

[11] Patent Number: 4,951,347

[45] Date of Patent: Aug. 28, 1990

[54] BRUSH-TYPE CLEANING SYSTEM

[75] Inventors: Roger D. Star; Arvin Karas, both of St. Charles, Ill.

[73] Assignee: Elgin Sweeper Co., Elgin, Ill.

[21] Appl. No.: 471,662

[22] Filed: Jan. 23, 1990

Related U.S. Application Data

[63] Continuation of Ser. No. 425,325, Oct. 26, 1989, abandoned, which is a continuation of Ser. No. 194,843, May 17, 1988, abandoned.

[51] Int. Cl.[5] ..... E01H 1/08

[52] U.S. Cl. ..... 15/340.3; 15/346; 15/368

[58] Field of Search ..... 15/340.3, 346, 368

[56] References Cited

U.S. PATENT DOCUMENTS

| | | | |
|---|---|---|---|
| 3,007,191 | 11/1961 | Braun | 15/346 X |
| 3,886,623 | 6/1975 | Landesman et al. | 15/340.3 X |
| 4,110,864 | 9/1978 | Gunnarson | 15/346 |
| 4,773,121 | 9/1988 | Young | 15/346 |

FOREIGN PATENT DOCUMENTS

| | | | |
|---|---|---|---|
| 2405331 | 6/1979 | France | 15/346 |
| 28282 | 10/1910 | United Kingdom | 15/346 |

OTHER PUBLICATIONS

"Public Works" dated Sep., 1987–p. 82.

Two page publication by FMC Corporation Sweeper Division Vanguard 7000 heavy duty sweeper.

Brochure–CROSSWIND (TM) 4–Wheel Recirculating Air Street Sweeper by Elgin Sweeper Company–1987.

One page document from Schwarze Industries, Inc. dated spring 1988.

*Primary Examiner*—Chris K. Moore

*Attorney, Agent, or Firm*—Leydig, Voit & Mayer

[57] ABSTRACT

Apparatus for cleaning surfaces includes a cleaning head defining an open-faced chamber for facing the surface to be cleaned and means for blowing air into the chamber. A rotary brush is positioned in the chamber for engaging and brushing the surface to be cleaned, and, preferably, the flowing air is directed in a stream that directly impinges the surface to be cleaned adjacent the brush. It is also preferred for the brush to be carried on an arm movable between a first position for engaging the surface to be cleaned and a second position where the brush is spaced from the surface to be cleaned. A control system is provided for power means for moving the brush and arm between the first and second positions, to cause the brush and arm to assume the first position when the motor is on to operate the brush, and to cause the brush and arm to assume the second position when the motor is off.

18 Claims, 2 Drawing Sheets

FIG. 1
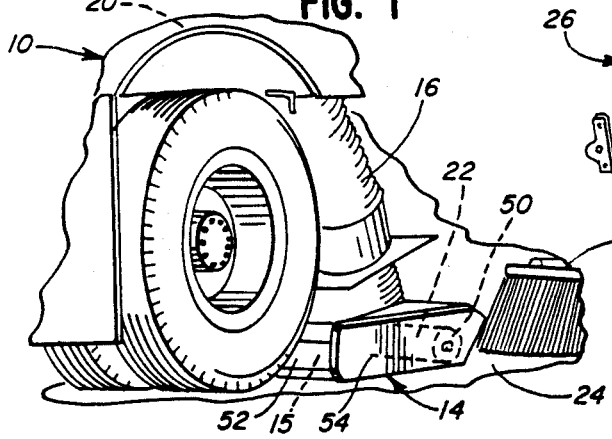
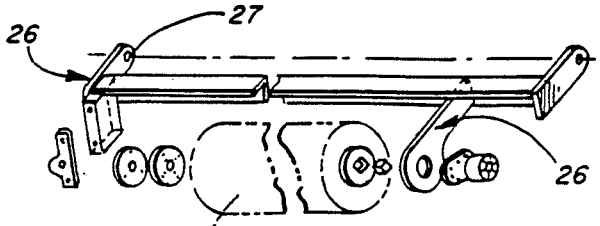
FIG. 4
FIG. 2
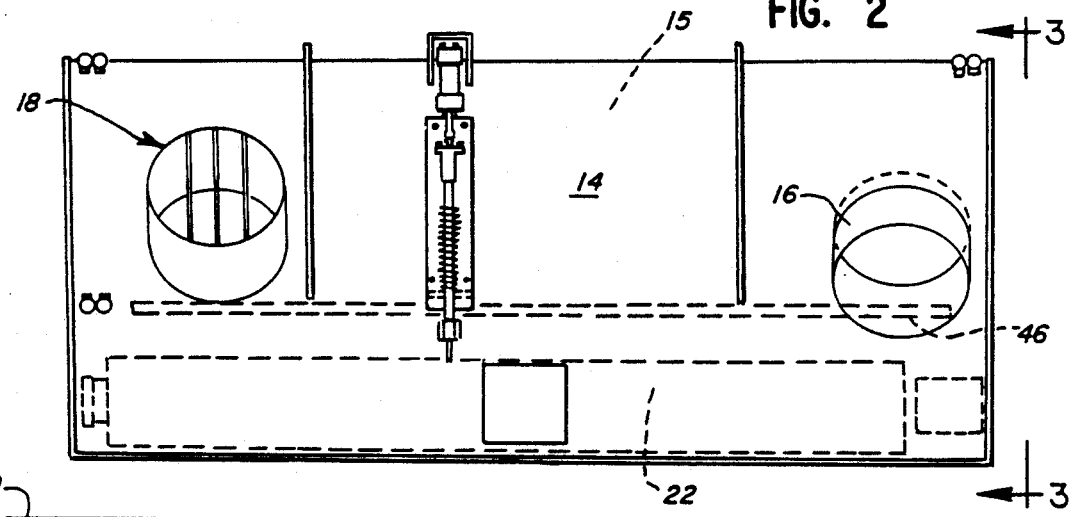
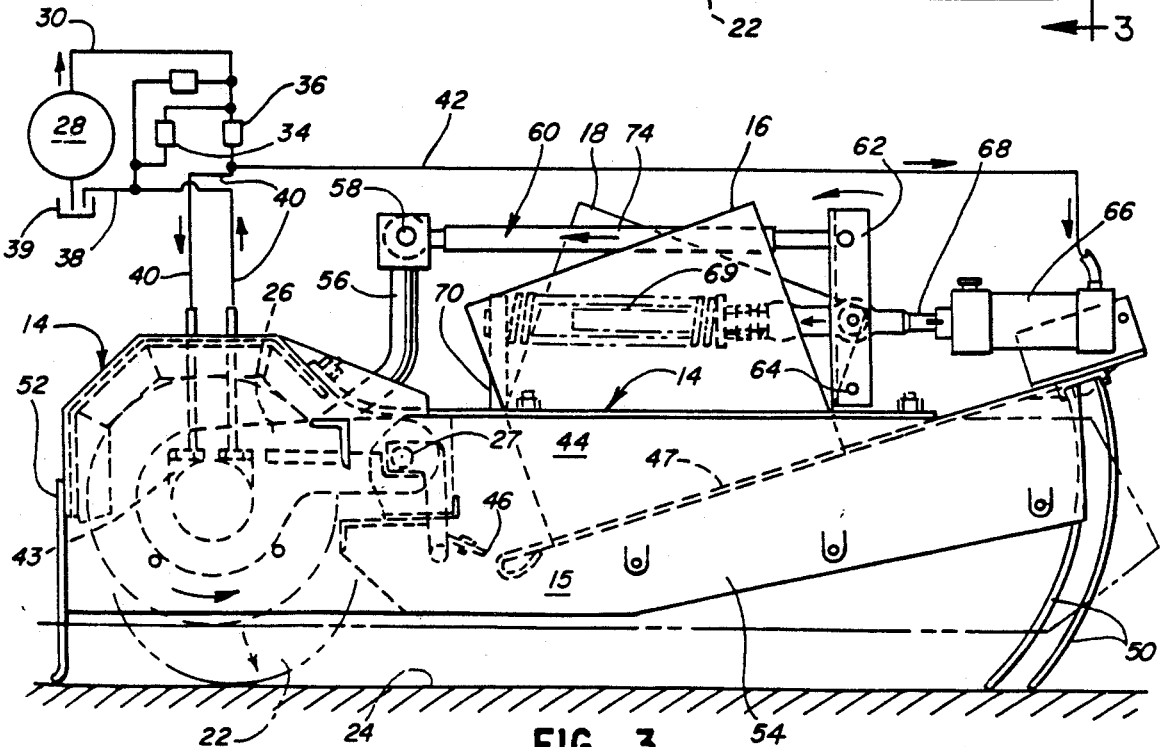
FIG. 3

FIG. 5
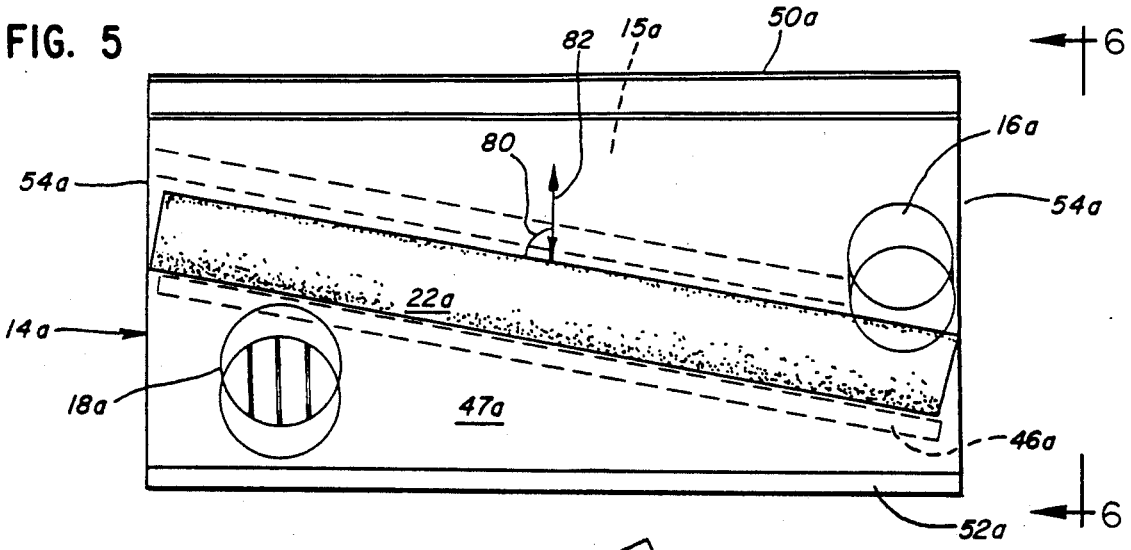
FIG. 6
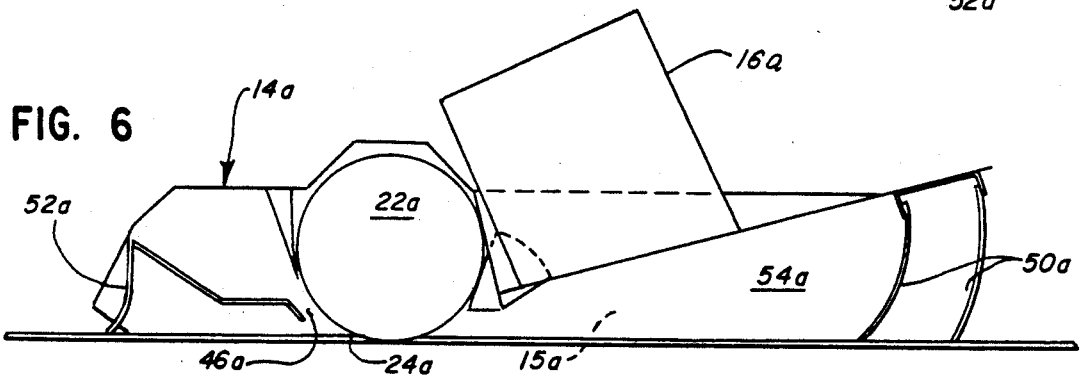
FIG. 7
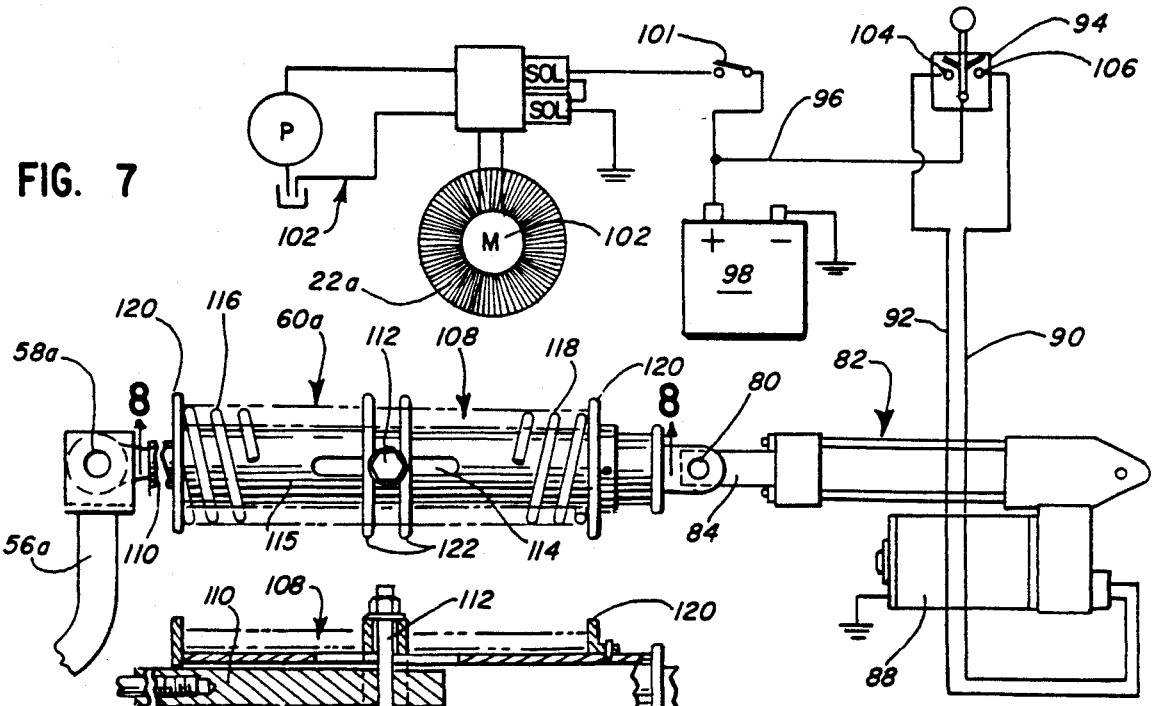
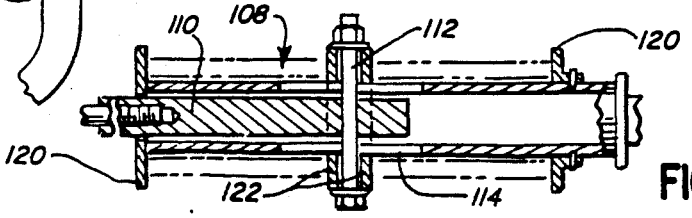
FIG. 8

BRUSH-TYPE CLEANING SYSTEM

This is a continuation of copending application Ser. No. 425,325, field on Oct. 26, 1989, now abandoned; which is a continuation of Ser. No. 194,843, filed on May 17, 1988, now abandoned.

BACKGROUND OF THE INVENTION

Street sweepers and the like typically use a rotary brush to dislodge dirt on the street, or other surface being cleaned. In one popular type of street sweeping device, the dirt which has been disturbed by a brush passes into a cleaning head, and is drawn into a recirculating air flow pattern which conveys the dirt to a dust collector, and permits the air with removed dirt and reduced dust to recirculate back to the cleaning head. One example of such a street sweeper is the CROSS-WIND brand recirculating air street sweeper of Elgin Sweeper Company, a subsidiary of Federal Signal Corporation, of Elgin, Ill. Another type of street sweeper which utilizes a rotary brush and an air suction mechanism is the Vanguard street sweeper sold by FMC Corporation, Pomona, Calif.

However, improvements in the efficiency and effectiveness of the street sweeping or other surface cleaning process would be desirable to provide a new, higher speed, and more effective generation of large-sized surface cleaning devices.

In accordance with this invention, a significant increase in the effectiveness and efficiency of surface cleaning devices is provided, for better removal of adhering dirt from a street or other surface, and for more complete collection of loosened dirt over which the apparatus of this invention passes.

Additionally, the broom of the apparatus of this invention is carried on an improved type of suspension for the broom, providing automatic and efficient raising of the broom when its operation is not desired, to reduce unnecessary wear thereon. This is accomplished in an efficient, effective manner without the need for a separate driver control to raise the broom when its operation is not desired.

DESCRIPTION OF THE INVENTION

This invention relates to apparatus for cleaning surfaces, typically with recirculating air flow including a cleaning head defining an open-faced chamber for facing the surface to be cleaned. Air recirculating conduit means is provided for drawing air from the chamber through a first port in the chamber, and for blowing air through a second port into the chamber. The air recirculating conduit means includes impeller means for circulating air through the conduit means and dirt collector means in the conduit means.

In accordance with this invention, a rotary brush is positioned within the open-faced chamber for engaging and brushing the surface to be cleaned. The second port is positioned to direct flowing air from the air recirculating conduit in a stream that directly impinges the surface to be cleaned adjacent to the brush. It has been found that a significant and surprising increase in dirt collection capability is provided by the combination of a rotary brush positioned in an air circulation chamber plus a blast of flowing air in a stream which directly impinges the surface to be cleaned adjacent to the brush.

Preferably, the second port defines a slot extending most of the width of the cleaning head, to produce a wide, flat stream of blowing air, and the brush correspondingly extends most of the width of the cleaning head, being preferably a cylindrical rotary brush. Also, as is well known, the open-faced chamber may carry resilient, flat means extending about the open face, particularly on the front and rear sides, the flat means extending into effective engagement with the surface to be cleaned, to provide at least a partial seal of the chamber and air recirculating conduit means. The side walls of the chamber typically constitute rigid skid members to support the chamber as it moves along or very near to the ground.

The apparatus is typically mounted on a vehicle such as a street sweeper, and in one preferred embodiment the stream of blowing air impinges the surface to be cleaned forward of the rotary brush. In this circumstance, the rotary brush typically rotates to move forwardly at its point of engagement with the ground, so that the brush tends to dislodge and drive debris forwardly into the impinging, blowing stream of air. Likewise, the first port is positioned in this circumstance forward of the rotary brush to receive and carry away blown air and the debris that it carries.

As another embodiment, the rotary brush may extend most of the width of the cleaning head, but is inclined at an acute angle to the front-rear axis of the cleaning head. The acute angle may preferably be essentially 60 to 85 degrees. In this circumstance, the brush may rotate across the surface to be cleaned in a forward direction, as before, but the stream of blowing air impinges the surface at a position rearwardly but adjacent to the brush. In this embodiment, the blown air and the disturbed debris is carried forwardly through the bristles of the rotating brush, assisted by the rotary motion of the brush. The first port is then positioned forward of the brush to suck air out of the area forward of the brush plus the debris carried therewith.

The apparatus of this invention may make use of many of the other known features of the prior art. For example, a dirt deflector may be laterally carried within the cleaning head as disclosed in the Jajko et al. U.S. Patent Application Ser. No. 172,549, filed Mar. 24, 1988 and entitled Dirt Deflector for Cleaning Heads, now U.S. Pat. No. 4,807,327. The separation of dirt and debris from the air stream can be accomplished by a system as described in Hilger U.S. patent application Ser. No. 096,550, filed Sept. 14, 1987 and entitled Dust Separator for Gas Stream.

Additionally, the invention of this application relates to a suspension system for the brush for engaging and brushing the surface to be cleaned, whether or not used in conjunction with an air blast or an air recirculating system. In this invention the brush may be carried on arm means and movable between a first position for engaging the surface to be cleaned and a second position where the brush is spaced from the surface to be cleaned. Typically, the arm means is a pivoted arm for raising the brush from the street into the second position.

A motor is provided for operating the brush for cleaning action, typically by rotation of a cylindrical brush which is horizontally disposed with respect to the surface to be cleaned. Power means are provided for moving the brush and arm between the first and second positions described above. By this invention, control means are provided for the power means for causing the brush and arm to assume the first position when the motor is on to operate the brush, and also to cause the brush and arm to assume the second position when the motor is off and the brush is not operating. Thus, when the operator turns on the brush motor to cause it to rotate or otherwise move to dislodge dirt, the brush is simultaneously lowered from the second, non-operating position to the first, surface-engaging preset position as a direct function of the turning on of the brush motor.

The brush motor may be hydraulically operated with pressurized fluid conduit means providing pressurized fluid and motive power to the hydraulic motor. The power means in this circumstance may comprise a hydraulically actuated piston and cylinder connected to the fluid conduit means. As a result of this, hydraulic operation of the motor, providing pressurized fluid to it, also causes spontaneous actuation with the same pressurized fluid of the piston and cylinder, to move the brush and arm to the first position. Then, when the hydraulic motor is shut off to terminate brushing action, spring means are provided urging the brush and arm toward the second, non-operating position. Thus the brush spontaneously moves into road-engaging position when the hydraulic motor is operating, and it spontaneously retracts when the motor is shut off.

Means may be provided for spatially adjusting the first, road engaging position so that the brush may be slightly raised or lowered with respect to the surface to be cleaned as desired for maximum brushing efficiency. In the specific embodiment described below, the spatial adjusting means includes extension rod means mechanically connected between the power means and the brush and arm. A turnbuckle member is provided for adjusting the length of the rod means.

In an alternate embodiment for the brush suspension means, the power means may be an electrically controlled linear actuator, for example of the type manufactured by Warner Electric Brake and Clutch Company of South Beloit, Ill. In this circumstance, the control means may include electric circuit means linking the operation of the motor and linear actuator. Thus, in typical operation of such a system, the linear actuator can advance the brush and arm into the first, operating position. The linear actuator can also retract the brush and arm to the second, non-operating position.

Advantages of this system include the fact that the linear actuator may be programmed to move to any of a series of closely spaced, different first positions so that small adjustments may be made in the height of the brush above the surface being cleaned in a manner that can be controlled from the operator cab of the street sweeper.

Additionally, the above apparatus may carry spring-type shock absorber means, being linked between the brush and arm, and the linear actuator. Accordingly, the brush and arm will be carried on a spring suspension for greater compliance with the road or other surface to be cleaned and the like.

While the inventions of this applications are preferably used together in a single apparatus, they may be also used separately, each one being independently usable apart from the presence of the other.

DESCRIPTION OF THE DRAWINGS

In the drawings, FIG. 1 is a fragmentary, perspective view of a street sweeping machine utilizing a recirculating air flow cleaning head having a brush mounted therein in accordance with this invention;

FIG. 2 is an enlarged plan view of one embodiment of the cleaning head of this invention;

FIG. 3 is an end view taken along line 3—3 of FIG. 2 of the cleaning head of this invention;

FIG. 4 is a fragmentary perspective view of the brush and its mounting in the cleaning head of this invention;

FIG. 5 is a plan view of a modified cleaning head in accordance with this invention;

FIG. 6 is an end view taken along line 6—6 of FIG. 5;

FIG. 7 is a partially diagrammatic elevational view of a different embodiment of a suspension system for raising and lowering the brush in the cleaning head; and FIG. 8 is a longitudinal sectional view taken along line 8—8 of FIG. 7.

DESCRIPTION OF SPECIFIC EMBODIMENTS

Referring to FIGS. 1 through 3, a street sweeper 10 is disclosed, which may be designed in accordance with current designs of commercially available street sweepers sold, for example, by the Elgin Sweeper Company of Elgin, Ill., except as otherwise indicated herein. As shown in FIG. 1, sweeper 10 may carry side brushes 12 for directing dirt and debris centrally into the path of the advancing cleaning head 14. As shown particularly in FIG. 2, cleaning head 14 defines an air recirculating conduit of generally conventional design for drawing air from a chamber 15 defined within cleaning head 14 through a first port 16 in the chamber, and for blowing air through a second port 18 into the chamber. The air recirculating conduit includes conventional impeller means for circulating air through the conduit means and dirt collector means in the conduit means, being of a conventional design such as used in the Crosswind (TM) four-wheel recirculating air street sweeper sold by Elgin Signal Company, all generally indicated by reference numeral 20 at FIG. 1.

Cleaning head 14 carries a rotary brush 22 within the open faced chamber 15 of head 14, the open face of chamber 15 being faced downwardly so that brush 22 is capable of projecting through the open face into brushing contact with the street or other surface to be cleaned 24.

Brush 22 may be of the cylindrical rotating type as shown, and is carried on a pivoting frame 26, being attached in a generally conventional manner as shown in the exploded view of FIG. 4, making use of appropriate washers, bolts and nuts in a conventional manner. Also, brush 22 may be rotatable for operation by a conventional drive system. In FIG. 3, a typical hydraulic drive system is disclosed in which pump 28 drives hydraulic oil through line 30. Solenoid valves 34 and 36 work in a manner opposite to each other so that one solenoid valve opens in its respective flow line while the other is closed. When solenoid valve 34 is open while solenoid valve 36 is closed, hydraulic oil shunts through line 38 in a short circuit system to reservoir 39, and brush 22 does not rotate. When solenoid valve 36 is open and solenoid valve 34 is closed, pressurized hydraulic oil flows through line 40 to a conventional hydraulic brush rotating mechanism 43 as shown in FIG. 3. In this circumstance, the pressure of the hydraulic fluid in lines 30, 40 is significantly increased because of the work being done, so that pressurized hydraulic fluid also enters line 42, which is joined to line 40, to actuate a brush lowering system to be described below. However when solenoid valve 34 is open and valve 36 is closed, the oil pressure in line 40 is greatly reduced in the shunting mode, causing a corresponding reduction in the pressure of line 42 and the deactivation of the brush lowering system.

In accordance with this invention, as shown in FIG. 3, blowing air entering second port 18 enters into upper chamber 44. From there the pressurized air is directed downwardly through transverse slot 46 of wall 47. Slot 46 directs the flowing air from the air recirculating conduit in a stream that directly impinges the surface to be cleaned 24 adjacent brush 22. It has been found that the combination of counterclockwise rotating brush 22 (from the FIG. 3 viewpoint) and the direct blast of air through slot 46 which directly impinges the surface to be cleaned adjacent the brush, provides a significant increase in the cleaning ability of the apparatus of this invention. The stirred-up dust and air is then withdrawn through first port 16 into the air recirculating conduit means 20, and conveyed to the dirt collector means.

As is conventional, cleaning head 14 carries front and rear flaps 50, 52 made of rubber, which enter into effective engagement with the surface 24 to be cleaned. This, coupled with side walls 54 with skids that engage the ground 24, provide at least a partial seal of the chamber and air recirculating conduit means.

Further in accordance with this invention, pivotable arm means 26, which carries rotary brush 22 and rotates about pivots 27, are positioned to pivot upwardly and downwardly so that the brush can strongly engage the ground 24 or be raised out of engagement therewith, as shown by the two positions of brush 22 in FIG. 3. Arm 26, in turn, is connected to angled bar 56 which, in turn, is pivotally connected at pivot 58 to shaft 60. Shaft 60, in turn, is pivotally connected to lever member 62, which lever member rotates about end pivot 64. Hydraulic cylinder 66 is provided, having an actuating piston 68 and operatively connected with hydraulic line 42, which line is connected, as described above, to hydraulic line 40.

Accordingly, when hydraulic motor 43 is actuated by the operator to rotate broom 22 for sweeping action, the pressurized fluid in line 30 produced by pump 28 not only passes through solenoid valve 36, but it also pressurizes line 42. This, in turn, spontaneously causes the advancement of piston 68, which advances lever 62. Lever 62, in turn, via shaft 60 and lever 56 forces pivoted arm 26 and brush 22 downwardly into engagement with the ground 24 to provide vigorous scrubbing action of the surface.

Similarly, when the operator shuts off motor 43 by opening solenoid valve 34 and automatically therewith closing valve 36, the pressure in line 42 is quickly reduced to that of the shunt circuit through line 38. In that circumstance, compression spring member 69, which is pivotally attached to lever 62 at one end and to support bar 70 at the other, pushes lever 62 to the right, causing retraction of piston 68 and raising of brush 22.

Thus, brush 22 is automatically lowered upon actuation of hydraulic motor 43 to rotate the brush. The lowered position of brush 22 may be spatially adjusted as desired because extension rod 60 constitutes a turnbuckle. Accordingly, as the outside portion 74 of extension rod 60 is rotated, the overall length of rod 60 may be varied. This, in turn, provides variation in the pivoting position of arm 26 and consequently the position of brush 22 relative to ground 24. Thus, as the brush wears, or in the event the pressure of the brush against the ground should be varied, turnbuckle 74 may be rotated to provide the desired adjustment. Upon shutting off of valve 36 and opening of valve 38, brush 22 stops rotating, and is retracted.

Turning to FIGS. 5 and 6, a modified embodiment of the cleaning head of this invention is disclosed. Cleaning head **14*a* is similar in structure and function to the previous embodiment, except as otherwise described below. As before, blower inlet 16*a* and blower outlet 18*a* are provided in cleaning head 14*a*, for air communication into and out of chamber 15*a* which is open at the bottom so that brush 22*a* may engage the ground for cleaning purposes. Air is provided through slot 46*a* from inlet port 18*a* for direct impingement on the ground adjacent to roller brush 22*a***. The other structure disclosed in the previous embodiment may also be used in appropriately modified form, such as the brush raising and lowering system.

By way of distinction of the embodiment of FIGS. 5 and 6 over the previous embodiment, cylindrical brush **22*a* and slot 46*a* are shown to be inclined at an acute angle 80 to the front-rear axis 82 of cleaning head 14*a*. As an additional distinction, slot 46*a* is positioned so that the stream of blowing air impinges surface 24*a* rearwardly and adjacent to brush 22*a*, which is shown to be rotating counterclockwise so that its lower surface is moving forwardly against surface 24*a*. As a result of this, air from slot 46*a* and disturbed debris is carried forwardly by the rotating brush, the air passing through the rotating bristles. The greatly disturbed, swirling air and debris is picked up through forwardly positioned first port 16*a*** for conveying the air and debris to the dirt collector through the conduit means.

As before, cleaning head **14*a* may carry a pair of flexible front flaps 50*a* and a rear flap 52*a* to cooperate with side plates 54*a* similar to plates 54**, to provide at least a partial seal of the chamber and air recirculating conduit means.

Referring to FIGS. 7 and 8, an alternative embodiment for the brush raising and lowering system is disclosed. In the embodiment shown, connection rod **56*a* is similar to connection rod 56 of the previous embodiment, being connected to a pivotable arm which carries rotatable brush 22. Connecting rod 56*a* is connected to pivot 58*a* as in the previous embodiment, which is, in turn, connected to a shaft 60*a* of generally similar function but different design to shaft 60 of the previous embodiment. Shaft 60*a* connects at its opposite end to pivot 80 which, in turn, connects to an electrically operated linear actuator 82 of conventional, commercially available design, to extend or retract plunger 84 and thus to move shaft 60*a*, pivot 58*a*, and connecting rod 56*a* to the left or right, to raise or lower the frame and brush 22*a*** in a manner similar to the previous embodiment.

Linear actuator 82 is connected to operating motor 88 which, in turn, is connected to a pair of circuit wires 90, 92. Such a linear actuator may be purchased from the Warner Electric Brake and Clutch Co. of South Beloit, Ill.

Wires 90, 92 communicate with control switch 94 which, in turn, communicates by wire 96 to a source of electric power 98. Additionally, wire 100 communicates through switch 101 with a conventional hydraulic system 102 for rotating brush **22*a***.

Actuation of switch 94 to the left into connection with terminal 104 will close the circuit between power source 98 and wire 92, causing linear actuator 82 to advance plunger 84.

When switch 94 is closed to the right to contact terminal 106, electric current from source 98 passes through wire 90 to activate linear actuator 82 to retract plunger 84. In this embodiment the rotation of brush 22 is separately controlled by switch 101.

If desired, a more sophisticated control system may be provided in conventional manner, making use of the capability of a linear actuator 82 to advance or retract plunger 84 to any of a number of positions, so that the vertical position of brush 22*a* may be correspondingly controlled with precision.

In the embodiment of FIGS. 7 and 8, a suspension system 108 is provided. As shown particularly in FIG. 8, rod 110 is shown to communicate with pivot 58*a*. Rod 110 communicates with cross bolt 112 which is slidable in slot 114 of outer sleeve 115. A pair of springs 116, 118 are respectively pressed between end plates 120 carried on outer sleeve, and inner plates 122. Accordingly, as shock or other pressures hit brush 22*a* from a bump in the road or an abrupt depression, corresponding pressures will be applied to rod 110. This, in turn, will cause cross bolt 112 to be urged toward movement along slot 114, which movement is resisted in either direction by the respective springs 116, 118, plates 122 moving with cross bolt 112. Thus, a shock absorber system is provided, which further provides a certain level of compliance between brush 22*a* and an irregular surface along which it is moving. Nevertheless, the entire shaft 60*a* can be moved by actuator plunger 84 to raise and lower brush 22*a* through angled bar 56*a*.

The above has been offered for illustrative purposes only, and is not intended to limit the scope of the invention of this application, which is as defined in the claims below.

That which is claimed is:

1. In apparatus for cleaning surfaces with recirculating air flow including a cleaning head defining an open-faced chamber for facing the surface to be cleaned; air recirculating conduit means for drawing air from said chamber through a first port in said chamber, and for blowing air through a second port into said chamber, said air recirculating conduit means including impeller means for circulating air through said conduit means and dirt collector means in said conduit means; the improvement comprising, in combination:

a rotary brush positioned within said open-faced chamber for engaging and brushing the surface to be cleaned, said second port being positioned to direct flowing air from said air recirculating conduit in a stream that directly impinges the surface to be cleaned adjacent to and forward of said brush.

2. The apparatus of claim 1 in which said second port defines a slot extending most of the width of said cleaning head, to produce a wide, flat stream of flowing air.

3. The apparatus of claim 1 in which said brush extends most of the width of said cleaning head.

4. The apparatus of claim 1 in which said open-faced chamber carries resilient flap means extending about said open face into effective engagement with the surface to be cleaned, to provide at least a partial seal of said chamber and air recirculating conduit means.

5. The apparatus of claim 1 which is mounted on a vehicle.

6. The apparatus of claim 5 in which said brush rotates across the surface to be cleaned in a forward direction, the first and second ports being both positioned forward of said brush.

7. In apparatus for cleaning surfaces including a brush for engaging and brushing the surface to be cleaned, said brush being carried on arm means and movable between a first position for engaging the surface to be cleaned and a second position where the brush is spaced from the surface to be cleaned; a motor for operating said brush for cleaning action; power means for moving said brush and arm means between the first and second positions; said motor being hydraulically operated with pressurized fluid conduit means, said power means comprising a hydraulically actuated piston and cylinder connected to said fluid conduit means whereby hydraulic operation of said motor causes spontaneous actuation of said piston and cylinder to move the brush and arm means to the first position; and spring means urging said brush and arm means toward the second position when said motor is not hydraulically actuated.

8. The apparatus of claim 7 including means for spatially adjusting said first position.

9. The apparatus of claim 8 in which said spatial adjusting means includes an extension rod and means for mechanically connecting the extension rod between the power means and the brush and arm means, and a turnbuckle member for adjusting the length of the rod.

10. The apparatus of claim 7 in which said brush is a rotary brush.

11. The apparatus of claim 7 mounted on a vehicle.

12. The apparatus of claim 1 in which said brush is carried on a pivotable arm which can be raised and lowered by an electrically operated linear actuator.

13. The apparatus of claim 12 in which spring-type shock absorber means is present, linked between said brush and arm and the linear actuator.

14. In apparatus for cleaning surfaces with recirculating air flow including a cleaning head defining an open-faced chamber for facing the surface to be cleaned; air recirculating conduit means for drawing air from said chamber through a first port in said chamber and for blowing air through a second port into said chamber, said air recirculating conduit means including impeller means for circulating air through said conduit means and dirt collector means in said conduit means; the improvement comprising, in combination:

a rotary brush positioned within said open-faced chamber for engaging and brushing the surface to be cleaned, said second port being positioned to direct flowing air from said air recirculating conduit in a stream that directly impinges the surface to be cleaned adjacent said brush; said brush being carried on arm means and movable between a first position for engaging the surface to be cleaned and a second position where the brush is spaced from the surface to be cleaned; a motor for operating said brush for cleaning action; power means for moving said brush and arm means between the first and second positions; and control means for said power means for causing said brush and arm means to assume said first position when the motor is on to operate said brush and also to cause said brush and arm means to assume said second position when the motor is off.

15. The apparatus of claim 14 in which said motor is hydraulically operated with pressurized fluid conduit means, said power means comprising a hydraulically actuated piston and cylinder connected to said fluid conduit means whereby hydraulic operation of said motor causes spontaneous actuation of said piston and cylinder to move the brush and arm means to the first position, and spring means urging said brush and arm means toward the second position when said motor is not hydraulically actuated.

16. The apparatus of claim 15 in which said stream of blowing air impinges the surface to be cleaned forward of said rotary brush, said brush rotating across the surface to be cleaned in a forward direction to direct dirt toward said first port.

17. The apparatus of claim 16 including means for spatially adjusting said first position.

18. The apparatus of claim 17 in which said spatial adjusting means includes an extension rod and means for mechanically connecting the extension rod between the power means and the brush and arm means, and a turnbuckle member for adjusting the length of the rod.

* * * * *